US005251934A

United States Patent [19]

Gates

[11] Patent Number: 5,251,934

[45] Date of Patent: Oct. 12, 1993

[54] PAIR OF WHEELED SKATE-SKIS WITH BRAKES USABLE ON MOST TERRAINS

[76] Inventor: Patrick G. Gates, 9716 122nd St., Puyallup, Wash. 98373

[21] Appl. No.: 739,910

[22] Filed: Aug. 2, 1991

[51] Int. Cl.[5] ..... A63C 17/06

[52] U.S. Cl. ..... 280/842; 280/11.2; 280/11.23; 24/200

[58] Field of Search ..... 280/11.19, 11.2, 11.22, 280/11.23, 11.27, 841, 7.12, 7.13, 600, 11.3, 11.31, 11.32, 611, 623, 842; 188/70 R, 71.1, 72.1, 72.3, 72.9, 74, 75, 76, 344, 361; 24/200, 197, 198

[56] References Cited

U.S. PATENT DOCUMENTS

| | | | |
|---|---|---|---|
| 3,876,217 | 4/1975 | Copier | 280/11.23 |
| 4,033,596 | 7/1977 | Andorsen et al. | 280/11.2 |
| 4,050,705 | 9/1977 | Kreis | 280/11.2 |
| 4,072,317 | 2/1978 | Pommerening | 280/11.23 |
| 4,418,929 | 12/1983 | Gray | 280/11.23 |
| 4,943,075 | 7/1990 | Gates | 280/11.23 |

*Primary Examiner*—Richard M. Camby
*Attorney, Agent, or Firm*—Roy E. Mattern, Jr.

[57] ABSTRACT

Improvements made to wheeled skate-skis, set forth in U.S. Pat. No. 4,943,075, which are equipped with brakes, and used by a sportsperson who enjoys skating-skiing on the level, going uphill, and/or coasting downhill on various terrains, are: foot supporting channel cross sectional bodies made of injected molded plastic; wraparound binding portions secured to these bodies with fasteners to accommodate different foot sizes; longitudinal slots in flanges of these bodies which accommodate straps such as toe strap, and strapping material is cut, wrapped around one side of a buckle at one end and at other end thereof this strapping material in two layers is sewn on an angle to allow placement of a dowel, which removably secures strap to body at slot, with the angle of sewn slot providing a forward angle positioning of strap and buckle, and length of each longitudinal slot allows for movement of buckle positions, fore and aft, for different shoe sizes, and additional angular slots are sewn into toe strap to allow for different effective overall lengths of toe strap and buckle; top ankle support strap of wraparound binding has outside to inside, and inside to outside strap portions, modified to accept strapping material sewn to hook and/or loop fastening materials, in turn sewn onto shortened PVC portions of these straps, to thereafter accept hook and/or loop fastening materials sewn on separate strapping material; additional support and/or comfort is provided by inserts; and brake cables are kept close to ones body, by using leg straps.

12 Claims, 9 Drawing Sheets

PAIR OF WHEELED SKATE-SKIS WITH BRAKES USABLE ON MOST TERRAINS

CROSS REFERENCE

This application concerns improvements of the pair of wheeled skate-skis with brakes usable on most terrains made and used by the same applicant, Patrick G. Gates, as set forth in his U.S. Pat. No. 4,943,075, and the information set forth in his patent is incorporated into this application by reference.

BACKGROUND

The pair of wheeled skate-skis, with hand brakes, usable on most terrains, as illustrated and described in U.S. Pat. No. 4,943,075, has been improved, to continue the opportunity for a sportsperson to travel over many types of terrain having different surface structures, while traveling more safely and more comfortably. In the background of U.S. Pat. No. 4,943,075 the following patents were discussed:

| | | |
|---|---|---|
| 3,365,208 | 1968 | Duane E. Blanchard |
| 3,389,922 | 1968 | Edward H. Eastin |
| 3,749,413 | 1973 | John G. Nicolson |
| 3,767,220 | 1973 | Robert A. Peterson |
| 3,876,217 | 1975 | Henri Copier |
| 3,884,486 | 1965 | Sven Oscar Wilje |
| 4,033,596 | 1977 | John P. Andorsen |
| 4,050,705 | 1977 | Phillip Kreis |
| 4,363,492 | 1982 | Arne Ericksson |
| 3,829,111 | 1974 | Bryan Frederick Nicholls |
| 4,072,317 | 1978 | Rudiger Pommerening |
| 4,718,181 | 1988 | Oiviero Olivieri |
| 4,107,856 | 1978 | Rene Bourque |
| 4,418,929 | 1983 | William J. Gray |

SUMMARY

As related in U.S. Pat. No. 4,943,075, there are sportspersons who enjoy one or more of the sports of snow skiing or board skiing in the winter, water skiing or surf boarding in the summer, ice skating in the winter, roller skating or skate boarding in the summer, who, with other persons, also would like to travel more conveniently and safely in warm weather on walks, roads, lawns, and some other selected terrains, involving both climbing and coasting downhill. This all terrain pair of wheeled skate-skis with hand operated brake controls and brakes provides these sportspersons with such athletic equipment.

They select and wear a favorite pair of sport shoes, then step respectively on the channel serving as the supporting platform, housing, chassis, and/or body and firmly position their feet, in their shoes, and portions of their legs, on and over the channel by using wraparound binding portions, which during skating and skiing movements are held firmly in place.

Wheels with pneumatic tires large enough in diameter at seven inches, and wide enough at one and three quarters of an inch to roll over small irregularities, and yet small enough to keep the sportsperson's feet comparatively close to ground level, function with the other components, to provide the safe travel motion sought by the sportsperson.

The wheelbase is selectable in different embodiments depending on the size and weight of the sportsperson. Each embodiment provides the respective sportsperson with a feeling or experience of ski length stability and tracking, not afforded by shoe-length skates, yet the overall length is short enough to gain the advantages of a skating feeling or experience.

At all times when the sportsperson desires to slow down and/or stop, in each of his or her hands are levers to be moved, in turn moving brake operational control cables that extend down to the rear of each channel. There the control cables are connected to the pivotal linkage of caliper operated frictional braking pads, which are moved against spring return forces to contact the wheel rim sides to apply the braking forces.

These wheeled skate-skis have been improved. Injection molding processes are utilized to produce a strong channel like body or frame. Each body has underside strength ribs around wheel openings, and an underside rib extending throughout the central center line of the body or frame. Each body has a molded axle housing. Also each body has more material molded into respective places to serve as the brake housing, and to serve as a stronger front edge structure.

The wraparound bindings, in a rear bottom locale thereof, are secured to the body with bolt and nut fasteners passing through selected holes in the depending flanges of the body. By selecting different holes different foot size positions are created. The depending flanges have longitudinal slots positioned ahead of these selectable holes to accommodate the strap and buckle units secured at respective ends to either the body or the wraparound binding.

Strapping material is cut, then wrapped around one side of a buckle and sewn in place at one end, and at the other end is sewn on angles at spaced locations to create slots to receive dowels. The other end is inserted through a selected longitudinal slot and thereafter a dowel is inserted having a diameter larger than the width of the longitudinal slot to thereby anchor this strap and buckle unit in place relative to the body or frame. This longitudinal slot is long enough to provide different spacing of the strap and buckle unit to accommodate different shoe sizes. The angular positioning of the slots receiving the dowels in the strapping materials positions the strap and buckle unit in a forward leaning position to fit more comfortably and securely over the sportsperson's foot. The other strapping material to be adjustably received in the strap and buckle unit, in reference to a toe strap, is likewise held in place upon the insertion of a dowel in a sewn angular slot. In reference to the other portions of the wraparound binding, the other end of the strapping material is adjustably secured to the PVC portions of the wraparound binding by using hook and loop fasteners.

Additional firm support is obtained, in the wraparound bindings when needed, by placing a firm insert, at the heel and ankle location, which is preferably made of a stiffer PVC vinyl material Also the fitting of sportsperson's smaller feet is undertaken by placing inserts, also at the heel and ankle location, preferably made of closed-cell foam materials of selectable thicknesses.

The brake cables are kept closer to the sportsperson's body by using cable positioning and retaining straps, which are selectably positioned about a sportsperson's leg above his or her knee, and secured by using hook and loop fasteners. A clip is sewn to each of these retaining straps to open, then receive a portion of the brake cable, and thereafter to close about the brake cable.

These improvements serve to extend the versatility of these skate-skis with brakes which are usable in traveling over many types of terrain.

DRAWINGS

These improved pair of wheeled skate-skis with brakes which are usable on most terrains, is illustrated in the drawings wherein:

FIG. 1 is a perspective view of a sportsperson on the wheeled skate-skis as he or she is commencing coasting downgrade over terrain, with his or her hands holding the braking control levers, which will be hand operated, when necessary, to move the control cables, to in turn move the calipered bicycle type brakes into contact with the respective rear wheels, and showing the brake control cable retaining straps;

FIG. 2 is a perspective view of the left wheeled skate-ski, as viewed from the left side thereof, showing, in more detail, the left foot binding as it is arranged to support the left foot and left shoe, not shown, of a sportsperson, and illustrating, in more detail, the overall braking assembly on the left wheeled skate-ski, with portions of the length of the control cable, not shown, and showing the pneumatic tube-tire wheels, and also showing the securement of the wraparound binding to the body or frame;

Figure 1:
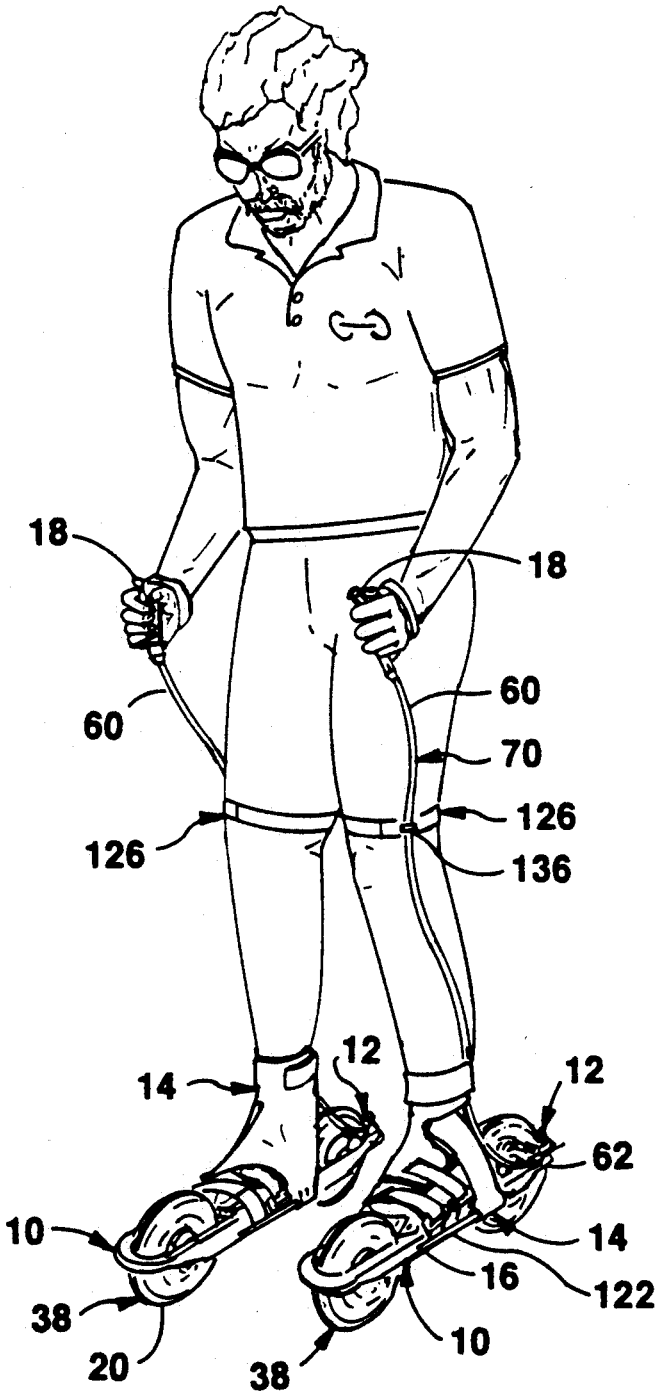
Figure 8:
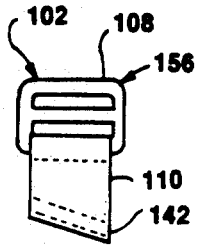
Figure 9:
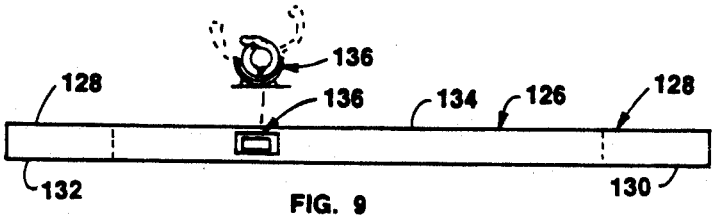
Figure 7:
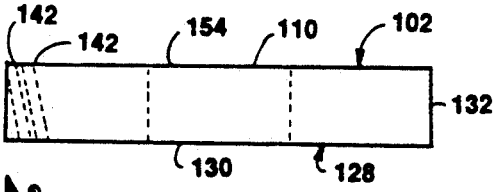
Figure 10:
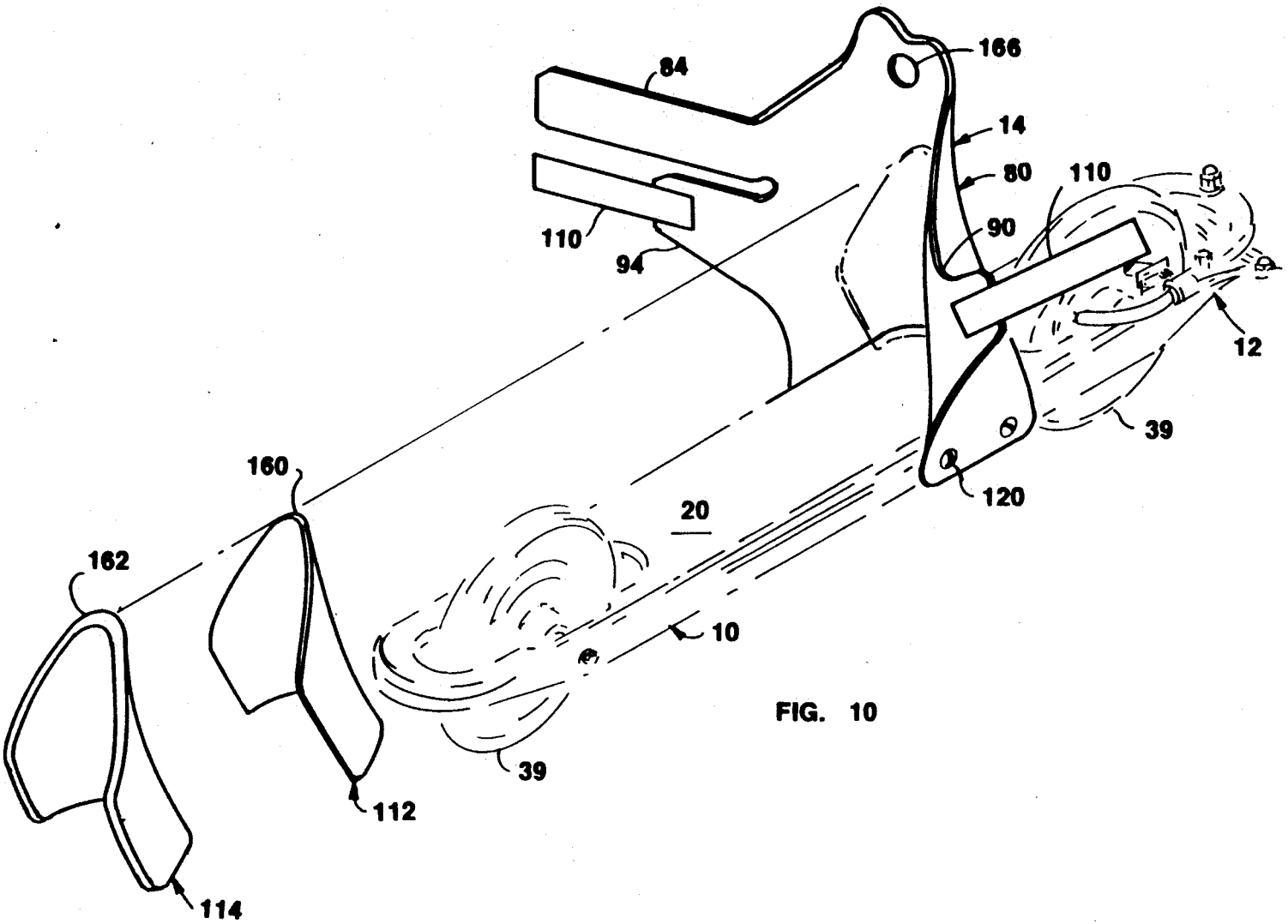
Figure 11:
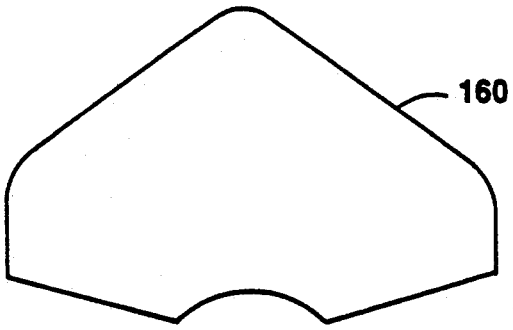
Figure 12:
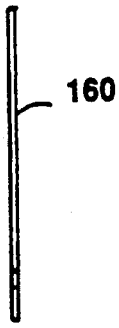
Figure 13:
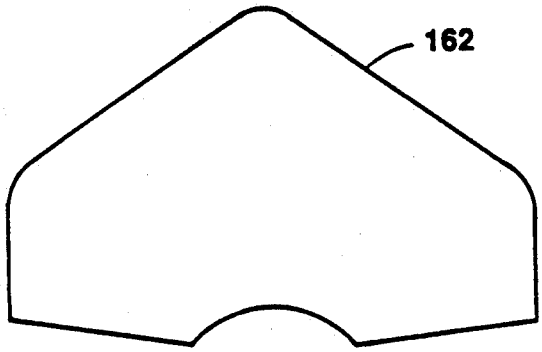
Figure 14:
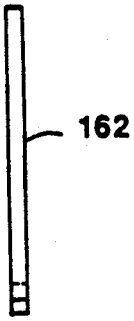
Figure 15:
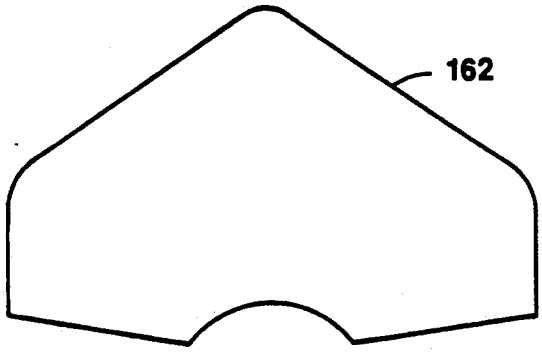
Figure 16:
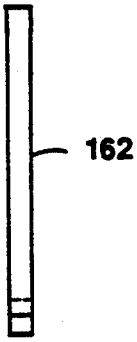
Figure 17:
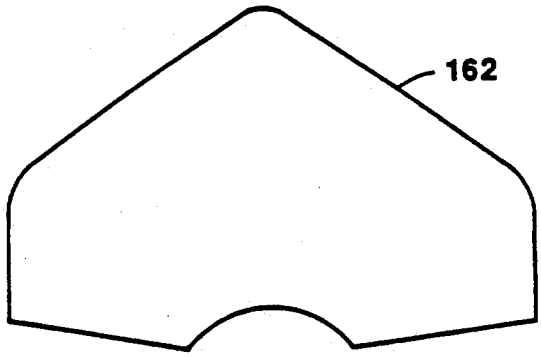
Figure 18:
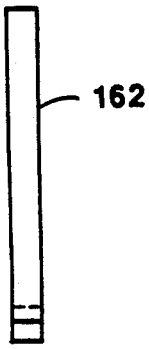
Figure 21:
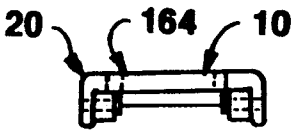
Figure 19:
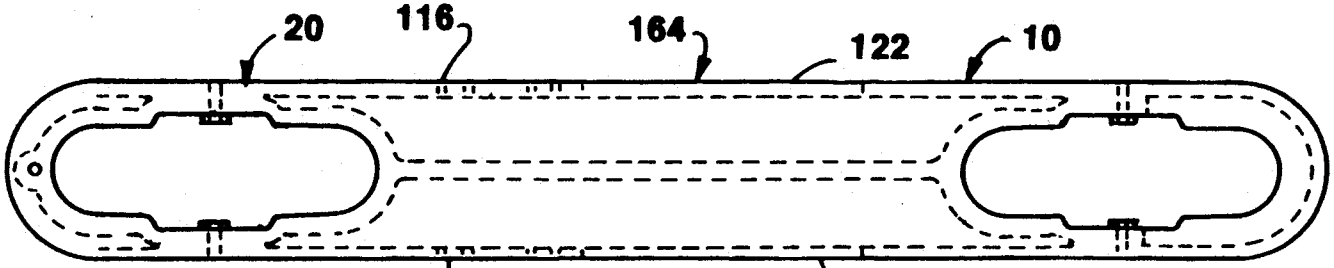
Figure 20:
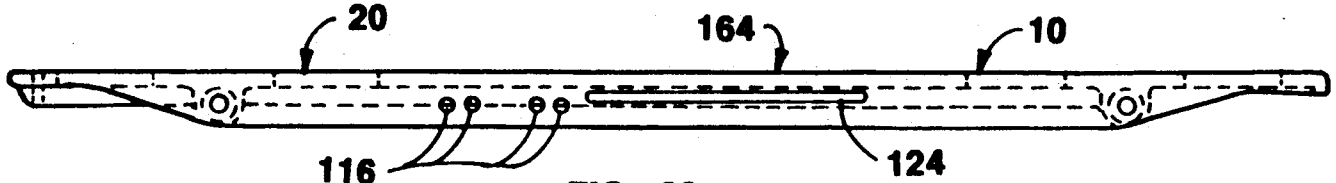

FIGS. 7 and 8 in planar views illustrate the overall toe strap and buckle of the wraparound binding, with FIG. 7, showing the adjustable-strap portion having selectable angular positioned sewn slots to receive a dowel, after threading the end of the strap portion through an elongated slot in the body to thereby hold the strap in place related to the body, and showing hook and loop fasteners on the adjustable-strap portion, and with FIG. 8 showing the buckle-strap portion also having an angular positioned sewn slot to receive a like dowel for a like anchoring purpose;

FIG. 9, illustrates in a planar view the brake control cable retaining straps, shown in FIG. 1, indicating the use of hook and loop fasteners and the sewn in place clip, which is opened to receive the cable and closed to retain the cable;

FIG. 10 is a partial perspective view, with portions shown in phantom lines, to illustrate how selectable inserts are optionally made available respectively for either increasing the firmness of the wraparound binding and/or filling in the wraparound binding with padded inserts to downsize the wraparound binding, when a person's smaller foot and shoe are to be fitted;

FIGS. 11 and 12 are respectively a planar view and a side view of a firmness increasing selectable insert made of stiffer material;

FIGS. 13 and 14, 15 and 16, 17 and 18, in pairs, illustrate in planar views and side views respective selectable padded inserts used to downsize the wraparound body; and FIGS. 19, 20, and 21 are respectively top, side, and end views, of the body or frame, which is molded using strong plastic materials, with the dotted lines indicating the underside reinforced and strengthened portions thereof.

DESCRIPTION OF THE PREFERRED EMBODIMENT

Introduction Regarding Using These Wheeled Skate-Skis

The preferred embodiment of the improved pair of wheeled skate-skis 10 with brakes 12 usable on most terrains is illustrated in the drawings. In FIG. 1, a sportsperson is shown as he or she is ready to go, having firmly positioned and supported his or her feet, with athletic shoes 16 on, to these wheeled skate-skis 10 using the bindings 14. Then with the hand controls 18 for the brakes 12 conveniently positioned, he or she is ready to get underway.

As illustrated the sportsperson is just commencing to coast down a grade of terrain. When the speed increases he or she will be changing their body positions by lowering their center of gravity and leaning forward. At all times the hand controls 18 for the brakes 12 are conveniently held and ready to operate to apply braking forces to one or to both wheeled skate-skis 10 to slow down and/or to stop. During braking operations, because of the convenience of the hand controls 18 for braking, the sportsperson remains in the most stable selected body positions for safely keeping his or her balance.

When coasting is completed, and skating motions are undertaken by the sportsperson to gain speed on a level surface or to climb a hill, the overall arrangement of all the components of these wheeled skate-skis 10 makes such skating motions very easy to perform. If such level and uphill maneuvers are to continue for a while, the sportsperson has the option to support the hand controls 18 for the brakes 12 on his or her belt, belt loop or other garment location.

The wheeled skate-skis 10 are provided in sizes with respect to both the overall length and the bindings 14. Each binding size, because of the use of "Velcro" or "Dual Lock", or like hook and loop fasteners and the buckles 108 and straps 110, and firmness inserts 112 and downsizing padded inserts 114, is well fitted with respect to a range of foot sizes. Likewise, each overall length of a wheeled skate-ski 10 is well fitted in respect to a range of foot sizes and weights of sportspersons.

Supporting Platform, Housing, Chassis, Frame, and/or Body

Throughout the continued designing and manufacturing of this improved pair of wheeled skate-skis with brakes 10 usable on most terrains the objective continued to utilize the best components selectable from readily available products, materials and fasteners. Preferably the supporting platform, also referred to as the housing, chassis frame and/or body 20 is now made of molded plastic, as particularly shown in FIGS. 19, 20, 21. By using the injection molding process of plastic material the body 20 is designed to reduce some of the parts that would be subsequently needed, and to increase the strength of selected portions. Also by using selected changeable die portions bodies 20 of different lengths are produced.

As particularly shown in FIGS. 1, 2, 4, 5, 19, 20, and 21, the exterior or top surface 24 of the molded body 20 serves as the supporting surface to receive the sportsperson's foot, within an athletic shoe 16. The left and right depending flanges 28 and 30 of this molded body 20 in addition to serving as strength members, also provide selectable holes 116, used when the wraparound binding 14, via the holes 118 thereof, received bolt and nut fasteners 120, to firmly connect the wraparound binding 14 to the molded body 20. These flanges 28 and 30 also have respective opposite elongated slots 122, 124, which slidably receive portions of straps 110. In addition these flanges 28 and 30 receive components of the brakes 12, portions of the transverse axles 34, with bearings not shown. The top portion 26 also referred to as the web portion 26 has molded openings 36 to accommodate the wheels 38, mounted on axles 34 and secured by fasteners 40. This web 26 has molded portions that extend around the wheels 38 to continue the overall strength of the body 20, serving as the supporting platform 20 and to provide bumpers 42. One of these extensions 42 or bumpers 42, preferably the aft or rear one, supports components of the brakes 12, and provides a hole 44, to receive a fastener 46 securing the components of the brakes 12 to the supporting platform, housing, chassis, or body 10.

The Braking Assembly Inclusive of Hand Operated Controls

Continuing with the selection of available products, essentially all of the braking assembly 50 to provide the brakes 12, as illustrated in FIGS. 1 through 5, is obtained from commercially available components. The selected type of brakes 12 are bicycle wheel type caliper operated frictional braking pads 52, which contact the rims 54 of the wheels 38. The two pivoting calipers 56 and 58 are pivotally mounted on the rear bumper 42 using the hole 44 and fastener 46. As particularly shown in FIG. 3, the upper positioned caliper 56 is connected by fastener 59, at one end to the housing 60 of the control cable 62, and at the other end, by fastener 64, to a braking pad 52. The lower positioned caliper 58 is connected at one end, by fastener 66, to the control cable 62, and at the other end, by fastener 68, to the other braking pad 52. Return springs 69 serve to move the braking pads 52 via the calipers 56 and 58 clear of the rims 54 when the braking forces are no longer needed.

The subassembly 70 of control cable 62 and cable housing 60 is extended to reach the waist heights of respective sportspersons, as illustrated in FIG. 1. At this upper end the brake lever 72 and the connector base 74 thereof is secured to rod 76, which is sized to fit in the palm of the hand of the sportsperson. Also the connector base 74 is secured to the housing 60 of the control cable 62 which, in turn, is connected to the brake lever 72. A strip 78 of "Velcro" or "Dual Lock" or like fastener is secured in part to the rod 76, and the free portions of this strip 78 are used to form a loop 78 which surrounds the hand or wrist of the sportsperson, when he or she is intending to use the brakes 12. When the sportsperson does not intend, for a period of time, to use the brakes 12, then he or she uses the strip 78 to form a loop 78 about his or her belt, belt loop, or other garment portion.

The operation of this braking assembly 50 is always conveniently undertaken whenever braking forces must be created. The sportsperson, via the manipulation of his or her fingers initiates and controls these braking forces. The sportsperson does not have to reposition his or her body solely to create braking forces. Instead he or she remains in the best selected body position in keeping with the speed of travel and the surface of travel.

Preferably, as shown in FIGS. 1 and 9, brake cable retaining straps 126 are used to keep the brake cables or control cables 62 and their housings 60 closely located to the sportsperson's body when skating. Hook and loop fasteners 128 with the respective components, i.e. the hooks 130, and loops 132, are sewn to the narrow strap 134. Between the ends of this narrow strap 134, a clip 136 is sewn to be opened to receive the housing 60 and brake or control cable 62 and to be closed to retain them, as shown by using the dotted lines in FIG. 9.

Figure 2:
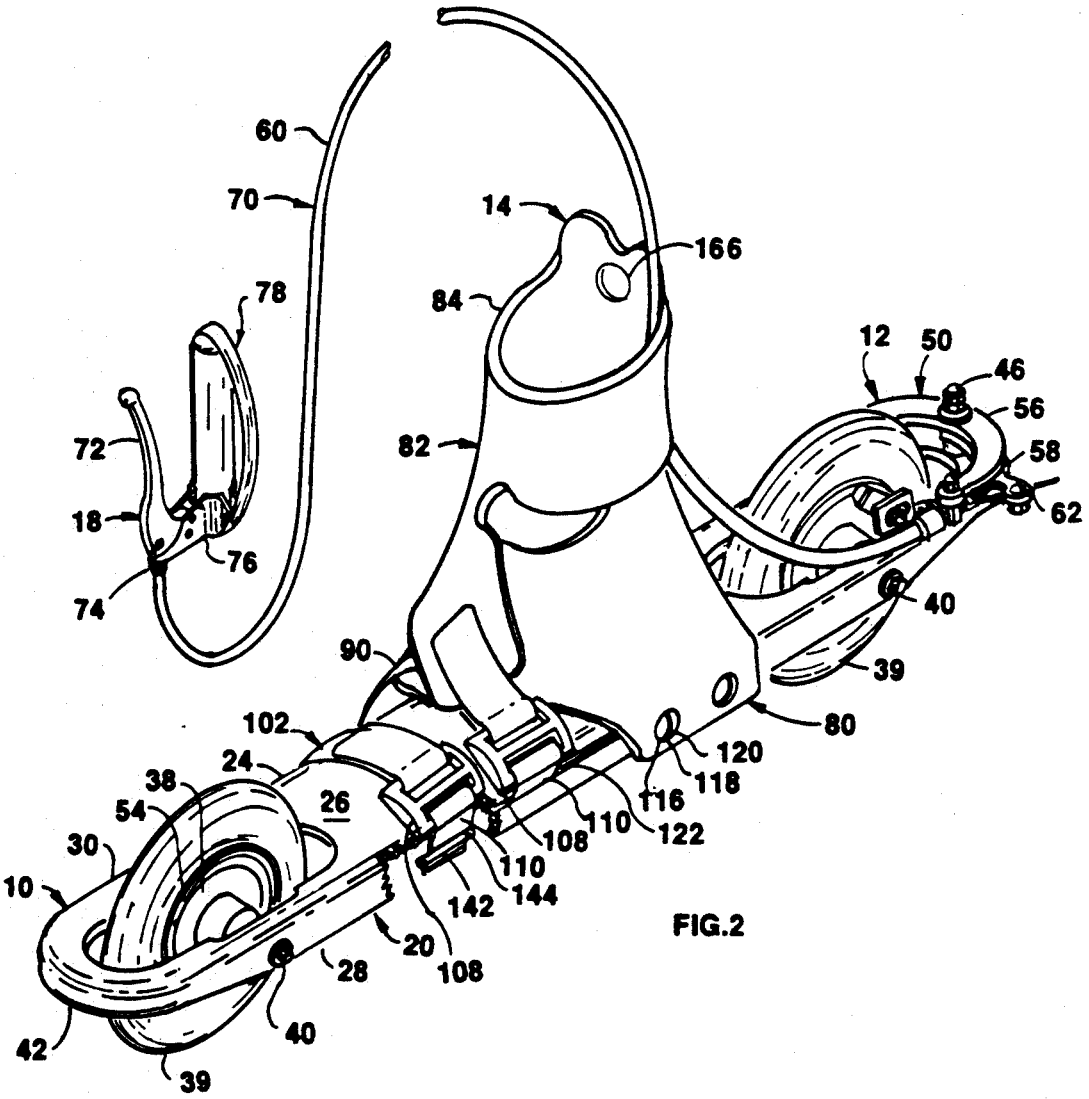
Figure 3:
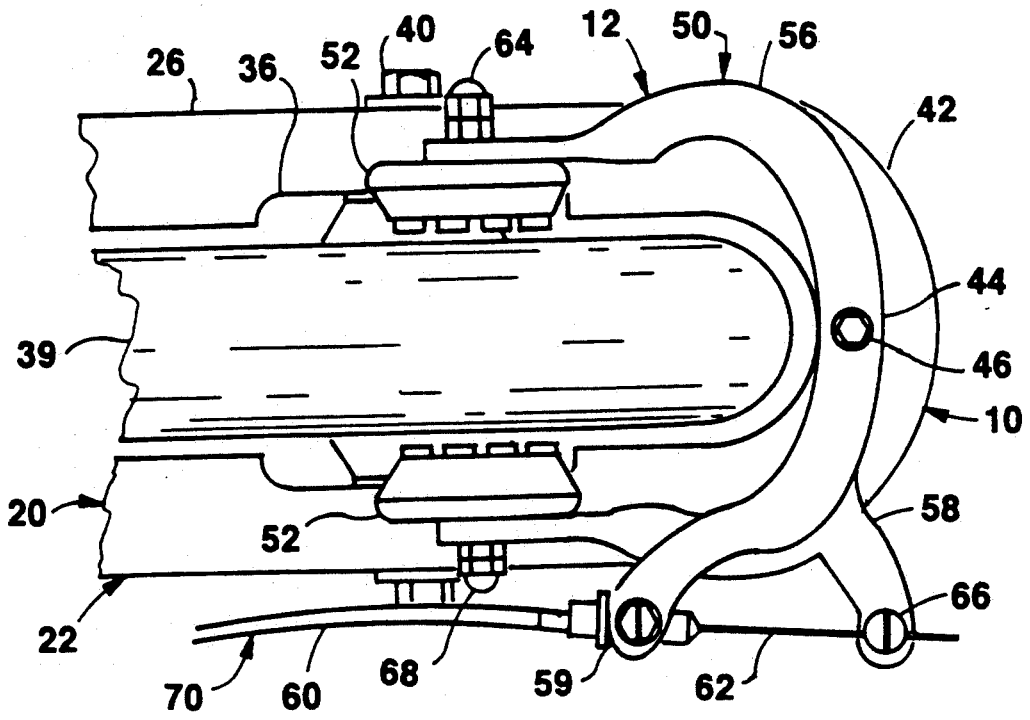
FIG. 3 is a partial top view of the left wheeled skate-ski to indicate the installed bicycle type calipered brake and portions of the control cable.
Figure 4:
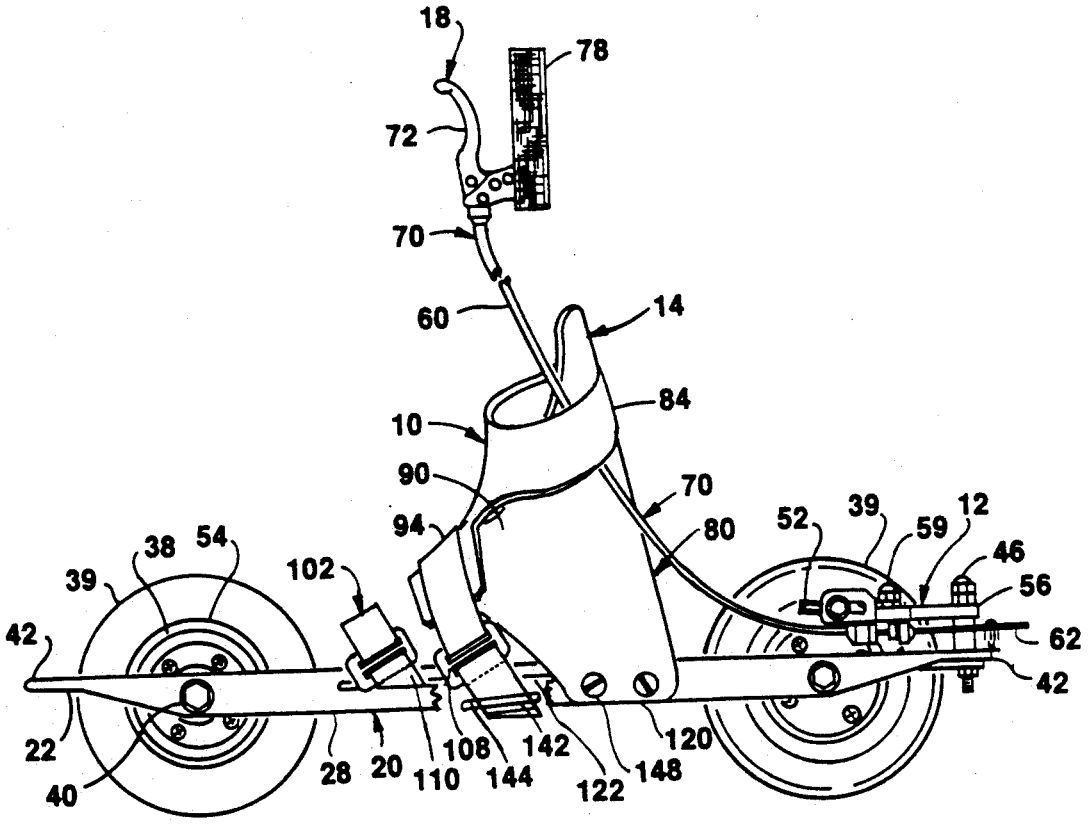
FIG. 4 is a left side view of the left wheeled skate-ski indicating how the control cable, shown in part, is connected between the hand operated braking lever, and the bicycle type calipered brake, and also showing how the control cable may be passed inside the leg encircling strap of the left foot binding, and also showing the strap and buckle arrangement of the wraparound binding.
Figure 5:
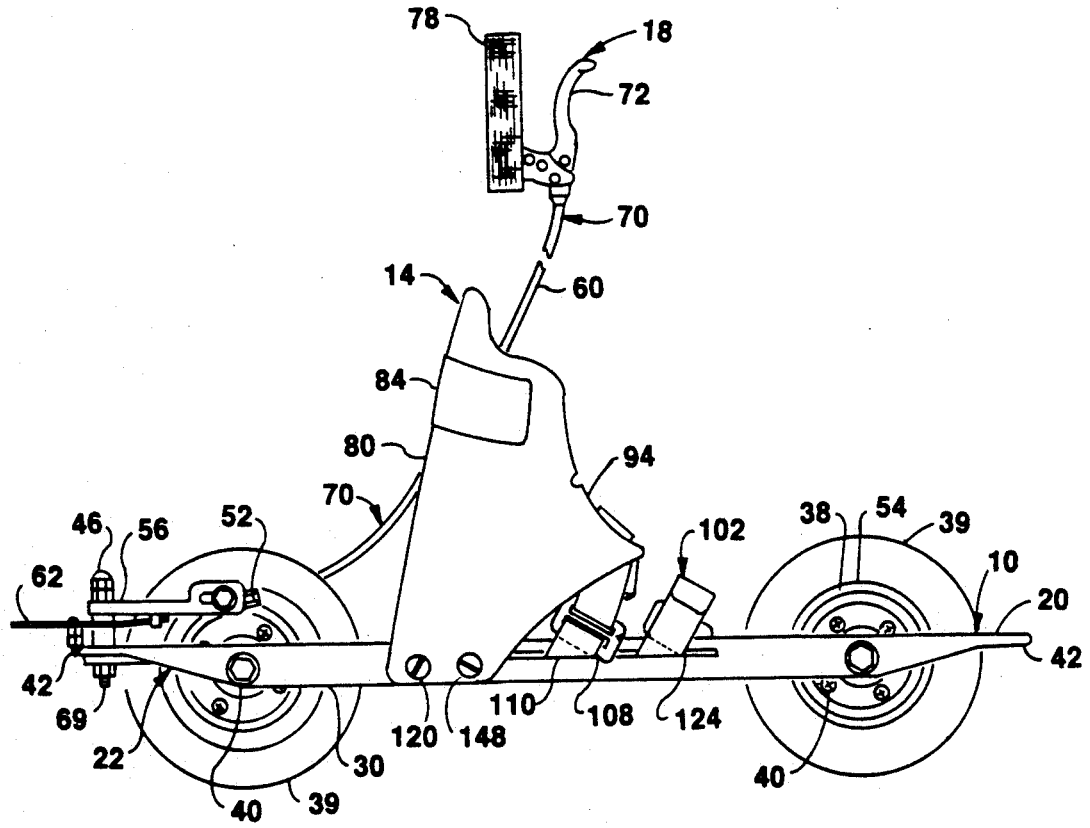
FIG. 5 is a right side view of the left wheeled skate-ski to indicate the different appearing arrangement of the straps and buckle of the left foot wraparound binding on this right side thereof.
Figure 6:
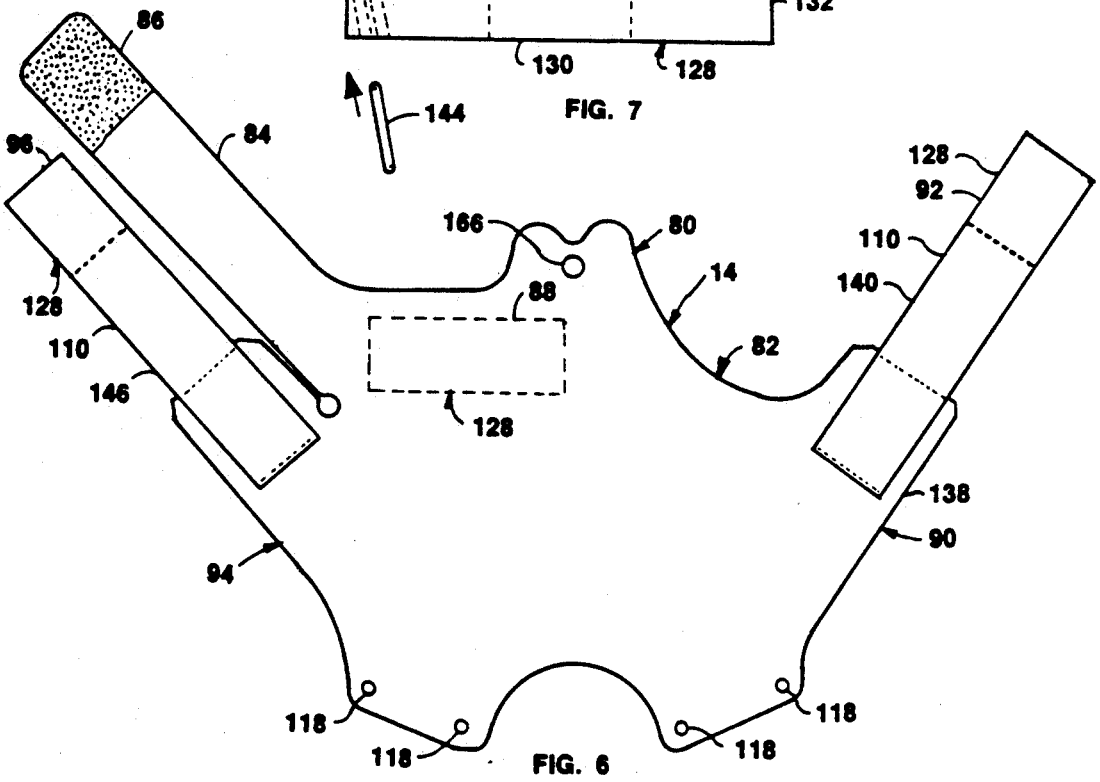
FIG. 6 is a planar view of the main or principal portion of the left foot wraparound binding, as this principal portion appears following manufacture, inclusive of "Velcro" or "Dual Lock" or like hook and loop fasteners, and as it appears before being installed about the left foot of a sportsperson, who has already placed his or her left foot into a selected sports shoe.

Adjustable, Wraparound Bindings to Hold a Sportsperson's Foot in Athletic Shoe to Wheeled Skate-Ski The respective wraparound bindings 14 shown in FIG. 1 are holding and supporting the sportsperson's foot in an athletic shoe 16 with respect to each wheeled skate-ski 10. In FIGS. 2, 4, and 5, respective bindings 14 are shown as they are secured in place with respect to a wheeled skate-ski 10. As illustrated in FIGS. 6, 7, and 8, in reference to a left foot binding 14, the removed binding 14 may assume a planar configuration when placed on a flat surface. Preferably a "P.V.C." vinyl material is used and "Velcro" or "Dual Lock" or like hook and loop fasteners are specifically placed at the needed designated locations.

In FIG. 6, an inside plan view is shown of the principal ankle-leg supporting portion 80 of the left foot binding 82. The right foot binding is the mirror image of the left foot binding and it is not illustrated.

Other portions of this principal ankle-leg supporting portion 80 are: the wraparound leg portion 84 of firmer material with its interconnecting respective hook and loop fastener portions 86, 88;

the outside to inside portion 90, commencing in the firmer material 138, and terminating in a sewn on strap material 140, having the hooks 130 and loops 132 of fastener 128, which is threaded through a buckle 108 sewn on a strap 110, which in turn has a sewn angular slot 142 to receive a dowel 144, after passing through one of the elongated slots 122, 124 of the body 20, to thereby anchor the strap 110 and buckle 108, which together receive the strap material 140, that is pulled through the buckle 108, folded back, and secured by using the hook and loop fastener 126 thereof;

the inside to outside strap portion 94 having its loop or hook fastener portion 96, sewn on a strap portion 146 and positioned through a buckle 108 sewn on a strap 110, which in turn has a sewn angular slot 142 to receive a dowel 144, after passing through one of the elongated slots 122, 124, of the body 20, to thereby anchor the strap 110 and buckle 108, which together receive the strap material portion 146, that is pulled through the buckle 108, folded back, and secured by using the hook and loop fastener 128 thereof; and at the bottom side edges of the firmer material of the wraparound binding 14 are spaced holes 148 to receive selected bolt and nut fasteners 150, which pass through these spaced holes 148, and selective sets of spaced holes 152 in the respective left and right depending flanges 28, 30, of the molded body 20, to secure the wraparound binding 14 to the molded body 20.

The other portion of the wraparound bindings 14 is the toe portion assembly 102, shown in FIGS. 7 and 8, in planar positions before assembly. In FIG. 7 is a strap portion assembly which will be passed over the toe portion of an athletic shoe 16 with the foot of the sportsperson inside, as shown in FIG. 1. This strap portion assembly 154 has a loop fastener 128 at one end, which, after going through a buckle 108 is folded back upon itself. At the opposite end, this strap portion assembly 154 has spaced selected sewn angularly positioned slots 142 to receive a dowel 144, after this opposite end has been passed through one of the elongated slots 122 or 124 of the body 20, which receive the strap ends. In FIG. 8, is strap 110 and buckle 108 assembly 156, with the strap 110 sewn, at one end, about the buckle structure, and at the other end, a sewn angularly positioned slot 142 is made to receive a dowel 144, after this other end of the strap 110 has been passed through an elongated slot 122 or 124, of the body 20, serving to anchor the strap 110 and buckle 108 to the body 20. When the strap portion assembly 154 is also secured to the buckle, then the toe portion assembly 102 is holding the toe portion of the athletic shoe 16 in place on the body 20.

By sewing the slots 142 on an angle which receive the dowels 144, the secured straps 110 and the others, such as strap portion 154, are comfortably, securely and angularly positioned in a conforming way to the contour of the instep portions of both the athletic shoe 16 and the foot of the sportsperson, as illustrated, particularly, in FIGS. 1, 2, 4, and 5.

These wraparound bindings 14 are strong, durable, easily manipulated, and securely positioned providing excellent support of the foot and leg of the sportsperson.

There may be times when a sportsperson desires extra firmness. If so, a firmer insert 112 is available to be inserted as indicated in FIGS. 10, 11, and 12. Also there may be times, when a sportsperson desires a closer fit and/or a padded fit. If so, a selected thickness closed-cell foam insert 114 is available to be inserted, as indicated in FIGS. 10, and 13 through 18. A hole 166 is formed in the bindings 14 which is used when the wheel skate-skis 10 are suspended from a support.

The Platform Also Referred to as the Housing, Chassis, Frame, or Body

In U.S. Pat. No. 4,943,075, a commercially available fiberglass structural channel was described in reference to how this channel was cut and drilled to form it into the platform, also referred to as the housing, chassis, frame, or body 20. With increased production the injection molded plastic platform 164, also referred to as the housing, chassis, frame or body 20 is being used, as illustrated in FIGS. 19, 20, and 21. The channel frame concept is the same, utilizing the inherent strength properties of such a channel frame. Improvements are added to the molded plastic frame or body 164 serving as the platform 20, to reduce the number of parts assembled, add strength portions at needed places, make the platform stronger and safer, reduce the overall weight, and reduce assembly time. The dotted lines in FIGS. 19, 20, and 21, show the underside locations of side flanges, strength ribs around wheel openings, and a strength rib through the center of the frame or body 20. The axle housing is molded into the frame or body 20, thereby eliminating spacers positioned between the wheels and the frame, and increasing the strength of the body 20. Additional plastic structure, distributed via the molding procedures, is positioned in the brake housing, and also in the front edge of the body 20 for added strength and safety.

The manufacturing molds are made to be supplemented and/or to be reduced to have production runs of different length bodies 20, to meet the market demand for different length wheeled skate-skis 10.

Hill Climbing With These Wheeled Skate-Skis

The brakes preferably have a brake-on-button to keep the brakes on when a person is using the wheel skate-skis to walk, and especially to walk uphill. Also when persons realize they will be very often walking uphill, or climbing uphill, they have wheel bearings installed, which allow only the forward rotation of the wheels 38. These bearings are oftentimes referred to as drawn cup roller clutch bearings.

Comments Regarding Sizes, Materials, Products and Uses

Regarding the brakes, a brake assembly designated as a "BMX" brake type has been used. These brakes have a brake-on-button to keep the brakes on when a person is using the wheel skate-skis to walk, and especially when he or she walks uphill.

The bearings used in the wheels are 5/16" inside diameter. The tube in the tire is inflatable up to 60 p.s.i. and the pressure is reduced at times when going downhill to help in increasing the drag to reduce the speed. The preferable tire size is 7" in diameter and $1\frac{3}{4}$" wide.

The control cable lengths are selected preferably in respect to waist heights of the sportsperson. There are times, when the lengths will be different. For example when being pulled by a large kite, a sportsperson has extended the control cable lengths placing the brake control levers in the locale with the hand held and operated kite controls.

Whatever the sizes, materials, products and uses selected, the resulting wheel skate-skis 10 provide the sportspersons with greater opportunities to enjoy this sport more thoroughly and with greater safety.

I claim:

1. An improvement to a pair of wheeled skate-skis with hand operated brakes for use on most terrains, having: a body with depending sides, having in turn a platform to receive a sportsperson's foot already fitted into a selected sport shoe; wheel receiving openings located both fore and aft in the body to receive fore and aft wheels, transverse holes in the depending sides by the wheel receiving openings to receive fore and aft transverse wheel axles, and at one end of the body, a vertical hole to receive a fastener used in mounting to the body, a bicycle type spring return pivotal calipered braking unit; said fore and aft wheels mounted on said fore and aft transverse axles positioned in the transverse holes in the depending sides; and said bicycle type spring return pivotal calipered braking unit mounted at the end of the web by having a fastener extending through the vertical hole in the body, and hand controls extending from this braking unit up tot he waist height locales of sportspersons, who will be using the pair of wheeled skate-skis having hand operated brakes, the improvement comprising:

a multipiece wraparound binding having a principal ankle-leg supporting portion made of plastic material, and a toe supporting portion made of strap material, with the principal ankle-leg supporting portion having holes to receive bolt and nut fasteners, with holes arranged in the depending sides of the body to be arranged opposite the holes in the principal ankle-leg supporting portion, and bolt and nut fasteners to pass through these respective holes to join together the principal ankle-leg supporting portion and the body, and the strap materials having ends cut on a bias and sewn with angular slots sized to snugly fit dowels, longitudinal slots formed in the depending sides of the body to receive the ends of strap materials cut on a bias, and the dowels inserted into the angular slots to serve as positioning anchors for the strap materials, buckles are secured to portions of the strap materials, and the strap materials, are joined together, and then the foot and shoe restraining straps are connected, which are angularly positioned to match the contour of a person's shoe and a person's foot.

2. An improvement to the pair of wheeled skate-skis, as claimed in claim 1, wherein the toe supporting portion has: a short strap, having one end sewn to one of the buckles, and the other end cut on a bias and sewn with an angular slot, and this cut end passes through a longitudinal slot formed in the depending side of the body, and one of the dowels is inserted in the angular slot to anchor this cut end to the body; and a longer strap, having at one end a hook and loop fastener for securement to one of the buckles, and having at the other end a bias cut and adjacent side by side angular slots to receive another one of the dowels, to anchor this bias cut strap end with respect to the longitudinal slot, and this toe supporting portion is thereby angularly positioned to match the contour of a person's shoe and a person's foot.

3. An improvement to the pair of wheeled skate-skis, as claimed in claim 2 wherein a leg strap having a receiving clip, secured by a hook and loop fastener, is positioned about the legs of a person using the skate-skis, whereby the receiving clip keeps the housing and brake control cable in a position closely adjacent the respective leg of the sportsperson riding on the wheeled skate-skis.

4. An improvement to the pair of wheeled skate skis, as claimed in claim 2, wherein a firm insert fits within the wraparound binding to add support to the foot and ankle of a person using these wheeled skate-skis.

5. An improvement to the pair of wheeled skate-skis, as claimed in claim 2, wherein a closed cell foam insert fits within the wraparound binding to downsize this binding and to provide a comfortable fit of this binding.

6. An improvement to the pair of wheeled skate-skis, as claimed in claim 5, wherein a firm insert fits within the wraparound binding to add support to the foot an ankle of a person using these wheeled skate-skis.

7. An improvement to the pair of wheeled skate-skis, as claimed in claim 1, wherein the body with depending sides is an injection molded body having rib like depending portions, which serve as reinforcing portions throughout this body.

8. An improvement to the pair of wheeled skate-skis, as claimed in claim 2, wherein the improved multipiece wraparound binding in respect to the principal ankle-leg supporting portion made of plastic material, as three portions:

the first portion is an ankle and leg segment having a wraparound leg portion;

the second portion is an outside to inside instep strap; and the third portion is an inside to outside overlaying instep strap.

9. An improvement to a pair of wheeled skate-skis with hand opened brakes for use on most terrains, having: a body with depending sides, having in turn a platform to receive a sportsperson's foot already fitted into a selected sport shoe; wheel receiving openings located both fore and aft in the body to receive fore and aft wheels, transverse holes in the depending sides by the wheel receiving openings to receive fore and aft transverse wheel axles, and at one end of the body, a vertical hole to receive a fastener used in mounting to the body, a bicycle type sprig return pivotal calipered braking unit; fore and aft wheels mounted on said fore and aft transverse axles positioned in the transverse holes in the depending sides; and said bicycle type spring return pivotal calipered braking unit mounted at the end of the web by a fastener extending through the vertical hole in the body, and hand controls extending form this braking unit up to the waist height locales of sportsperson, who will be using this pair of wheeled skate-skis having hand operated brakes, the improvement comprising a multipiece wraparound binding comprising in turn:

a. a principal ankle-leg support portion, in turn having six portions, wherein:

i. the first portion is an ankle and leg segment, made of plastic, having holes to receive fasteners which secure the first portion to the body with depending sides, and having hook and loop fastening material, and;

ii. the second portion is an outside to inside instep strap, made of strap material and sewn to the first portion, made of plastic, and having its hook and loop fastening material;

iii. the third portion is an inside to outside overlaying instep strap, made of strap material and sewn to the first portion, made of plastic, and its having hook and loop fastening materials;

iv. the fourth portion is a shorter strap material portion of the same width as the widths of the second and third straps, having at one end thereof an angular receiving slot sized to snugly fit a dowel, and having at the other end a squared end folded over portion of a first buckle and sewn together;

v. the fifth portion is said first buckle which is positioned on the fourth portion, when the sewn squared end thereof folds over a portion of said first buckle; and vi. the sixth portion is a dowel inserted into the angular receiving slot of the fourth portion to removably secure this fourth portion of shorter strap material to the body, with the depending sides; and b. a toe supporting portion, in turn having five portions, wherein:

i. the first portion is a rectangular strap material portion having at one end thereof, an angular receiving slot sized to snugly fit another dowel, and having at the other end thereof a squared edge for insertion into a second buckle;

ii. the second portion is a dowel for insertion into the angular receiving slot to create an active length of this first portion, and to removably secure this first portion to the body with the depending sides; and iii. the third portion is a shorter strap material portion of the same width as the first strap material portion, having at one end thereof, an angular receiving slot sized to snugly fit a dowel, and having at the other end a squared end, folded over a portion of a third buckle and sewn;

iv. the fourth portion is a fourth buckle which is positioned on the third portion, as the squared end thereof folds over a portion of said forth buckle and is sewn; and v. the fifth portion is another dowel for insertion into the angular receiving slot of the third portion to removably secure this third portion to the body with the depending sides; and c. fastener receiving holes, which are made in the depending sides of the body, to receive the fasteners used in securing the first portion, having holes to receive the same fasteners, whereby the ankle and leg segment of the principal ankle-leg supporting portion is secured to the body having depending sides;

d. fasteners passed both through the first portion which is the ankle and leg segment having the holes, and through the depending sides of the body having the holes;

e. elongated slots, which are made in the depending sides of the body, through which ends of the straps pass, and thereafter respective dowels inserted in the respective angular receiving slots of the respective straps removably retain the respective straps to the body having the depending sides, having in turn these elongated slots.

10. An improvement to a pair of wheeled skate-skis, as claimed in claim 9, wherein the first portion of the toe supporting portion has another angular receiving slot, parallel to and spaced form the original angular receiving slot, to provide an optional angular receiving slot sized to snugly fit a dowel, to thereby provide for a respective effective length of this first portion of the toe supporting portion.

11. An improvement to a pair of wheeled skate-skis, as claimed in claim 9, wherein the fastener receiving holes which are made in the depending sides of the body are arranged in multiple groups, whereby only a portion of them are sued at one time, thereby creating multiple positions where the principal ankle-leg supporting portion is secured to the body having depending sides, whereby different sizes of the feet of sportspersons are accommodated.

12. An improvement to a pair of wheeled skate-skis, as claimed in claim 10, wherein the fastener receiving holes which are made in the depending sides of the body are arranged in multiple groups, whereby only a portion of them are used at one time, thereby crating multiple positions where the principal ankle-leg supporting portion is secured to the body having depending sides, whereby different sizes of the feet of sportspersons are accommodated.

* * * * *